US005956957A

United States Patent [19]

Lowry et al.

[11] Patent Number: 5,956,957

[45] Date of Patent: Sep. 28, 1999

[54] CRYOSTAT APPARATUS

[75] Inventors: Jerald F. Lowry; Owen R. Christianson, both of Pittsburgh, Pa.

[73] Assignee: Siemens Westinghouse Power Corporation, Orlando, Fla.

[21] Appl. No.: 09/059,311

[22] Filed: Apr. 13, 1998

[51] Int. Cl.[6] ..... F25B 19/00; F17C 3/10

[52] U.S. Cl. ..... 62/51.1; 62/48.3

[58] Field of Search ..... 62/48.3, 51.1

[56] References Cited

U.S. PATENT DOCUMENTS

| | | | |
|---|---|---|---|
| 2,927,437 | 3/1960 | Rae | 62/48.3 |
| 3,412,320 | 11/1968 | Marshall | 62/51.1 |
| 3,431,347 | 3/1969 | Kafka et al. | 62/51.1 X |
| 3,545,226 | 12/1970 | Newell | 62/51.1 X |
| 3,724,228 | 4/1973 | Sollami et al. | 62/48.3 |
| 4,027,494 | 6/1977 | Fletcher et al. | 62/48.3 |
| 4,462,214 | 7/1984 | Ito | 62/51.1 X |
| 4,713,941 | 12/1987 | Toyoda et al. | 62/48.3 |
| 4,821,907 | 4/1989 | Castles et al. | 62/48.3 X |
| 4,986,077 | 1/1991 | Saho et al. | 62/51.1 |
| 5,220,800 | 6/1993 | Muller et al. | 62/51.3 |
| 5,226,299 | 7/1993 | Moiseev | 62/48.3 X |
| 5,417,073 | 5/1995 | James et al. | 62/51.1 |
| 5,441,107 | 8/1995 | Esser et al. | 62/51.1 X |

*Primary Examiner*—Christopher B. Kilner

[57] ABSTRACT

A cryostat having inner and outer vessels, with a containment vessel disposed in the interior of the cryostat spaced from the inner vessel wall. The containment vessel houses a superconducting coil immersed in a liquid helium bath which is prevented from contacting the inner vessel wall. Primary and secondary shielding arrangements help to intercept heat transferred by gas conduction and radiation. For relatively high power operation wherein the coil is charged and discharged frequently, the inner and outer vessels are fabricated of a non-magnetic composite material.

15 Claims, 3 Drawing Sheets

CRYOSTAT APPARATUS

BACKGROUND OF THE INVENTION

1. Field of the Invention

The invention in general relates to superconducting coils and more particularly to apparatus for maintaining the coil at the proper temperature for superconducting operation.

2. Description of Related Art

An electrical coil is capable of storing energy in the magnetic field produced by current flowing through the coil. If the coil is a superconducting solenoid or toroid, extremely large amounts of energy can be stored for relatively long periods of time due to the fact that once in the superconducting state, resistance of the coil winding approaches zero ohms enabling the winding to carry large currents with essentially zero loss.

Superconducting magnetic energy storage (SMES) systems find use in various fields such as industrial, transportation, and defense, as well as in the electrical utility industry. For example, SMES systems are being proposed for energy storage as part of Flexible AC Transmission Systems (FACTS) and custom power equipment for distribution-level power quality improvement.

SMES is an attractive option for these systems due to its relatively high energy storage density and available discharge rates at the multi-megawatt level. A bath-cooled SMES magnet fabricated using a low temperature superconductor (LTS) must be maintained near 4.2K by immersion in liquid helium or other suitable cryogenic fluid. If the SMES magnet is fabricated using a high temperature superconductor (HTS) it may be able to operate at a temperature somewhat above 4.2K, but will nevertheless require a cryogenic fluid for maintaining the magnet at its operating temperature.

Typically the magnet is a solenoid with a relatively large external magnetic field. The external magnetic field can be greatly reduced by using instead a toroidal coil configuration, but a toroid is more expensive to fabricate than a solenoid.

The bath-cooled solenoidal or toroidal SMES magnet is contained in a vessel called a cryostat. Cryostats are typically double-walled, vacuum-insulated vessels and are generally fabricated from stainless steel alloy, a relatively poor heat conductor. The cryogenic fluid (along with the SMES magnet) is contained in the inner vessel where it is thermally isolated (to a great extent) from the external environment. As will be described, such arrangement is extremely costly, not only when the SMES is in a standby condition but also when it is in service delivering power.

The present invention provides an arrangement which significantly reduces the operating costs with respect to the usage of cryogenic fluid.

SUMMARY OF THE INVENTION

Cryostat apparatus for maintaining a superconducting coil in a superconducting state includes outer and inner cylindrical vessels having a near vacuum condition in the space between them. A cover member encloses the interior volume of the cryostat. A containment vessel is positioned within the cryostat at a location which is spaced from the inner vessel wall with the containment vessel including the superconducting coil immersed in a cryogenic fluid.

For operation wherein high magnetic fields are produced and the magnet is charged and discharged frequently, it is preferred that the inner and outer vessels are fabricated of a non-metallic composite material. A first shield of a composite material surrounds the containment vessel and a second shield is provided around the first shield.

DESCRIPTION OF THE PREFERRED EMBODIMENT

Figure 1:
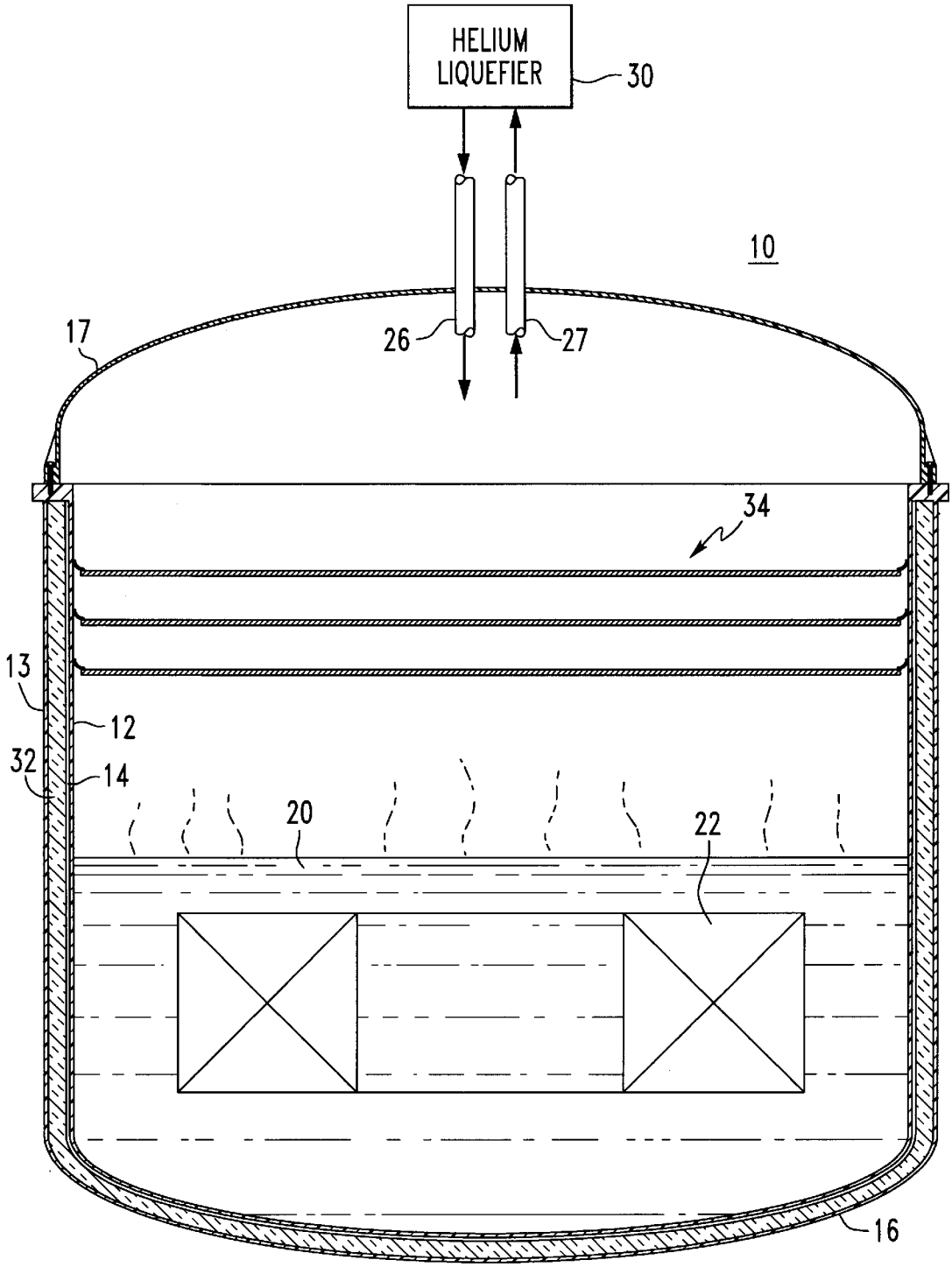
FIG. 1 PRIOR ART
FIG. 1 is a sectional view of cryogenic apparatus in accordance with the prior art.

In the drawings, which are not necessarily to scale, like or corresponding parts are denoted by like or corresponding reference numerals.

FIG. 1 is a simplified presentation of a typical cryostat. The cryostat 10 includes inner and outer spaced apart vessels 12 and 13, having cylindrical walls, with the space 14 between them being at an ultra low pressure which is substantially a vacuum. The cryostat 10 includes a lower end 16 and a cover 17 with the interior volume being filled to a certain level with a cryogenic fluid such as liquid helium 20. Disposed in the liquid helium bath 20 is a superconducting coil which constitutes a magnet, or solenoid 22 (conventional means for supporting the solenoid 22 in the cryostat 10 are not shown). Vacuum jacketed transfer lines 26 and 27, connected to a helium liquefier 30, respectively provide liquid helium to, and extract gaseous helium from, the interior of the cryostat 10.

The cylindrical wall of the inner vessel 12 is made as thin as possible to minimize wall heat conduction from ambient temperature to the liquid helium bath 20, while the vacuum space 14 between the inner and outer vessels 12 and 13 is fitted with a multi-layer insulation 32 to minimize radiative heat transfer from the warm (outer) vessel 13 to the inner vessel 12. The inner vessel 12 is typically fitted with thermal intercepts or heat stations (not shown) cooled with liquid nitrogen or cold helium gas to further reduce conductive heat transfer along metal walls and through the gaseous helium which fills the interior of the cryostat (at about one atmosphere absolute pressure). A system of baffle plates and shields 34 is used above the liquid helium bath 20 to minimize conductive, convective, and radiative heat transfer from the warm gas at the top of the vessel to the cold gas just above the liquid helium bath.

Even with a well-engineered design under DC (standby) operating conditions the amount of liquid helium required to cool a SMES magnet capable of providing a few megawatts of power for a few seconds is on the order of 25–50 liters/hour. The cost of providing even this small quantity of liquid helium is substantial. The capital cost of a helium liquefier system 30 capable of liquefying this quantity of liquid helium is extremely high. Further, the liquefier 30 requires liquid nitrogen for precooling and uses a helium compressor which requires about 100 kW of electrical energy. In addition, there are also labor costs to be considered for operation and maintenance of the equipment.

The liquid helium costs escalate sharply when the SMES magnet is in service, that is, when the magnet is being charged or discharged at megawatt power levels. As mentioned above, cryostat 10 is typically fabricated from stainless steel alloy and the magnet is generally a solenoid, with a large external field. The walls of the inner and outer vessels 12 and 13, as well as the dished heads or end plates 16 and 17 on the vessels effectively comprise "shorted turn" secondary windings which intercept significant amounts of the magnetic flux generated by the primary winding, that is, the SMES magnet. In fact, there are significant eddy current losses in any conducting structures within the changing magnetic field. Eddy current losses (or heating) in the walls of the liquid helium containment vessel (the inner vessel 12) as well as in any other metallic structures in contact with the liquid helium bath result in rapid boiloff and loss of liquid helium. The gaseous helium must be recovered and liquefied using expensive and inefficient liquefiers, as discussed above, or resupplied in bulk at high cost.

It may be shown that there are significant power losses in the cylindrical walls and dished heads of a stainless steel alloy, double-walled cryostat containing a 4 MJ SMES magnet which is being charged or discharged at a 2 MW power level, with the magnet energy decreasing to 20% of its initial value in 1.6 seconds. For example, the losses are estimated to be over 6 kW=6 kJ/sec, with about half of these losses occurring in the outer wall 13 and half in the inner wall 12. Since one Joule of heat input will evaporate about 48 mg of liquid helium, 3 kJ (heat input to the inner wall 12) will evaporate about 144 g of liquid helium, or 1.15 liters, and 3 kW will evaporate about 1.15 liters/sec which is 4145 liters/hour. A single 1.6 sec magnet charge or discharge will evaporate about 1.84 liters of liquid helium.

If the SMES magnet stores only a few megajoules and is discharged and recharged on a low duty cycle, for example, once or twice an hour, the additional burden on the liquefier 30 is manageable. However, if the storage capacity of the magnet is much larger, or if the magnet is discharging and charging at multi-megawatt levels, or is discharging and recharging frequently (or perhaps continuously), which is likely the case if it is coupled to a FACTS or custom power application, reliquefying the helium becomes a very costly proposition. For example, consider the relatively low 2 MW discharge/charge rate discussed above which could result in the vaporization of 4145 liters/hour of liquid helium if the magnet is in continuous use. The most efficient helium liquefaction process requires about 1.0 kW of electrical power to produce liquid helium at the rate of 1.0 liter/hour. Thus 4.15 MW of electrical power will be required to liquefy 4145 liters/hour. The capital cost of the liquefaction equipment for this task would be objectionably high. The option of resupplying the liquid helium from a bulk trailer is equally unattractive due to the high cost of each liter of liquid helium.

Figure 2:
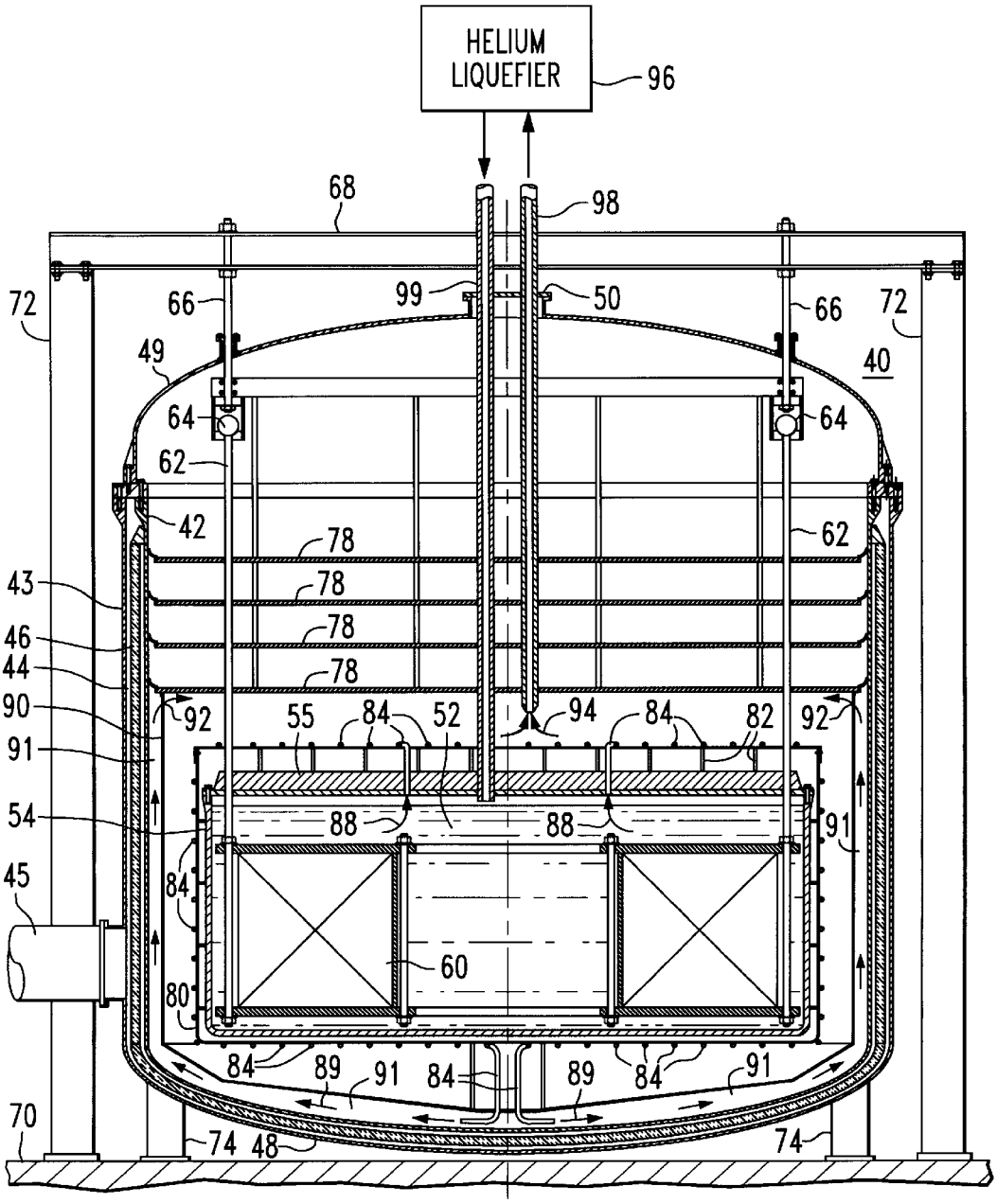
FIG. 2 is a sectional view of cryogenic apparatus in accordance with the present invention.

The present invention provides for a more cost-effective approach by reducing or eliminating the eddy current losses in the cryostat walls and also by thermally decoupling the wall losses from the liquid helium, or other cryogenic fluid, bath. In addition, the total quantity of costly liquid helium required is significantly reduced. FIG. 2 illustrates one embodiment of the present invention.

In FIG. 2, cryostat 40 includes inner and outer vessels 42 and 43, separated by a space 44 which is maintained at near vacuum conditions by apparatus connected to evacuation port 45, and which space 44 contains a multi-layered insulation 46 to effectively eliminate radiative heat transfer from the warmer outer vessel 43 to the cooler inner vessel 42. The cryostat 40 includes a dished lower end 48 and a top cover 49 having an access plate, or service port 50.

For very low duty cycle applications the inner and outer vessels 41 and 42, as well as the cover 49 may be fabricated from stainless steel. However for high power applications, as described herein, these vessels and cover are fabricated from a composite material such as a fiber reinforced epoxy, either by filament winding or by hand lay-up, by way of example.

The design of the cryostat 40 is such that no liquid helium contacts the wall of the inner vessel 42. Rather, the liquid helium 52 (or other cryogenic fluid) is situated within a separate cylindrical flat bottomed containment vessel 54, of composite material, having a cover member 55. Thus the inner vessel 42 does not have to be designed and fabricated to be leak-tight against liquid helium, but only to be leak-tight against cold gaseous helium.

Positioned within the containment vessel 54 is the superconducting coil such as solenoid 60. The solenoid 60 and containment vessel 54 are supported from outside of the cryostat 40 by support means which includes a plurality of support struts 62 which may be fabricated from stainless steel rod or tube, or of composite material. The struts 62 are affixed at their lower end to the solenoid 60 and containment vessel 54, and at their upper end to spherical bearings 64. Bearings 64 are connected by respective struts 66 to an external beam structure 68 which is supported from the floor 70 by means of support columns 72. The cryostat vessel itself, without the weight of the solenoid 60 or containment vessel 54, is supported on the floor 70 by means of a plurality of support legs 74.

Heat flows into the lower portion of the inner vessel 42 by means of radiation, conduction, and convection. Radiative heat transfer to the inner vessel 42 is minimized by the multi-layer insulation 46 in the vacuum space 44 between the inner and outer vessels 42 and 43 as well as by horizontal, parallel radiation shields or baffle plates 78 arranged between the solenoid 60 and the cryostat top cover 49. Heat conduction occurs both through (that is, vertically along) the inner vessel wall and through gaseous helium filling the interior of the cryostat 40. Wall conduction is minimized by making the composite wall as thin as possible.

Heat is conducted into the liquid helium 52 through the struts 62 and heat transfer from surrounding surfaces which are slightly warmer. However the primary source of heat transfer to the liquid helium is by gas conduction (and convection to a lesser extent) from the cryostat walls and the relatively warm gas in the top of the cryostat.

Conduction through the gaseous helium is minimized by maintaining the lowest baffle plate 78 at a temperature which is not much higher that that of the liquid helium bath itself. Finally, heat is transferred by convection, that is by circulation of gas currents in the volume above and around the liquid helium containment vessel 54. The primary function of the baffle plates 78 is to reduce convective heat transfer by preventing free flow of gaseous helium upward through the cryostat, thus causing the cold gas to remain in the bottom of the vessel and the warm gas to remain near the top.

Superior thermal management is accomplished with the provision of a first, or primary thermal shield 80, also of a composite material. The thermal management objectives are realized by making careful use of the cold gaseous helium boiloff from the liquid helium bath 52. Whatever heat eventually arrives at the liquid helium bath 52 causes vaporization of liquid, or boiloff, at the approximate rate of 1.38 liter/hour (liquid vaporized) for each watt of heat input. However, the helium vapor or boiloff is cold, being only very slightly above the bath temperature.

The "refrigeration power" of this cold gas can be used to intercept heat flowing toward the liquid helium containment vessel 54, thus heating the cold gas rather than the liquid helium. The refrigeration power of the gas is simply the difference in enthalpy of the cold gas between any two given temperatures. For example, let it be assumed that the temperature of the boiloff is about 4.4K whereas it is desired to maintain the temperature of the thermal shield 80 at 6K. The difference in enthalpy of helium gas at these two temperatures is 10.8 J/gm. With a helium mass flow rate of 1 gm/sec the cold gas could intercept 10.8 J/sec or 10.8 W of heat flow. The total helium mass flow rate may be on the order of several gm/sec, so that only a portion of the total will be needed to provide cooling to the thermal shield.

The thermal shield 80 may be carried by the containment vessel 54 by a series of standoffs 82, or it may be directly hung from the struts 66. Thin-walled tubing, such as of polytetrafluoroethelyene, is wound around the shield structure 80 and includes top ends 86 communicating with the interior volume of the containment vessel 54 allowing cold gaseous helium boiloff to pass into the tubing 84, as indicated by arrows 88, out over the top of the thermal shield 80, down along the sides and across the bottom. This gas cools the thermal shield 80, thus intercepting heat flowing in from the cryostat walls and down from the top of the cryostat by gas conduction.

From the bottom of the shield 80, the cold gas is directed to the bottom of the cryostat, as indicated by arrows 89, and into a second shield 90 which surrounds the first shield 80 and which is in close proximity to the inner vessel 42, defining a gas passageway 91 therebetween. The gas flows up in this gas passageway 91 between the wall of the inner vessel 42 and the second shield 90 and intercepts heat flowing down along the wall via wall conduction.

A series of apertures 92 near the top of the second shield 90 directs the relatively cold gas back toward the center of the cryostat and along the bottom surface of the lowermost baffle 78, thus providing gas cooling to the baffle arrangement. This gas is then returned, as indicated by arrows 94, to a helium liquefier 96 via a vacuum jacketed transfer line 98, which passes through service port 50, as does a similar vacuum jacketed transfer line 99 which supplies liquid helium from the liquefier 96 to the containment vessel 54.

As brought out above, the design of the cryostat 40 is such that there is no liquid helium in contact with the wall of the inner vessel 42 (as there is in the prior art design). Thus the wall does not have to be designed and fabricated to be leak-tight against liquid helium, but only to be leak-tight against cold gaseous helium. To ensure low helium gas permeability of the composite wall, the wall may be provided with a protective liner.

Figure 3:
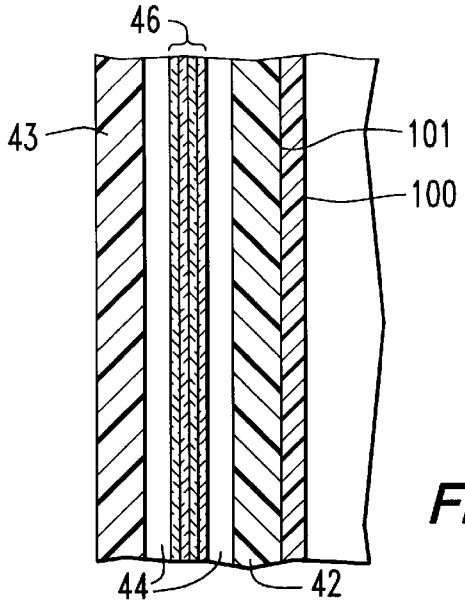
FIGS. 3 and 4 illustrate a cryostat with an inner vessel lining.

FIG. 3 illustrates one type of protective liner 100 which may be used. A section of the composite inner and outer walls 42 and 43 is shown, with a coating 102 being applied to the inner surface 103 of the inner vessel 42. The coating 102 in one embodiment may be a thin coating of pure resin similar to that used in the fabrication of the composite vessel 42, however devoid of any fiber content.

Figure 4:
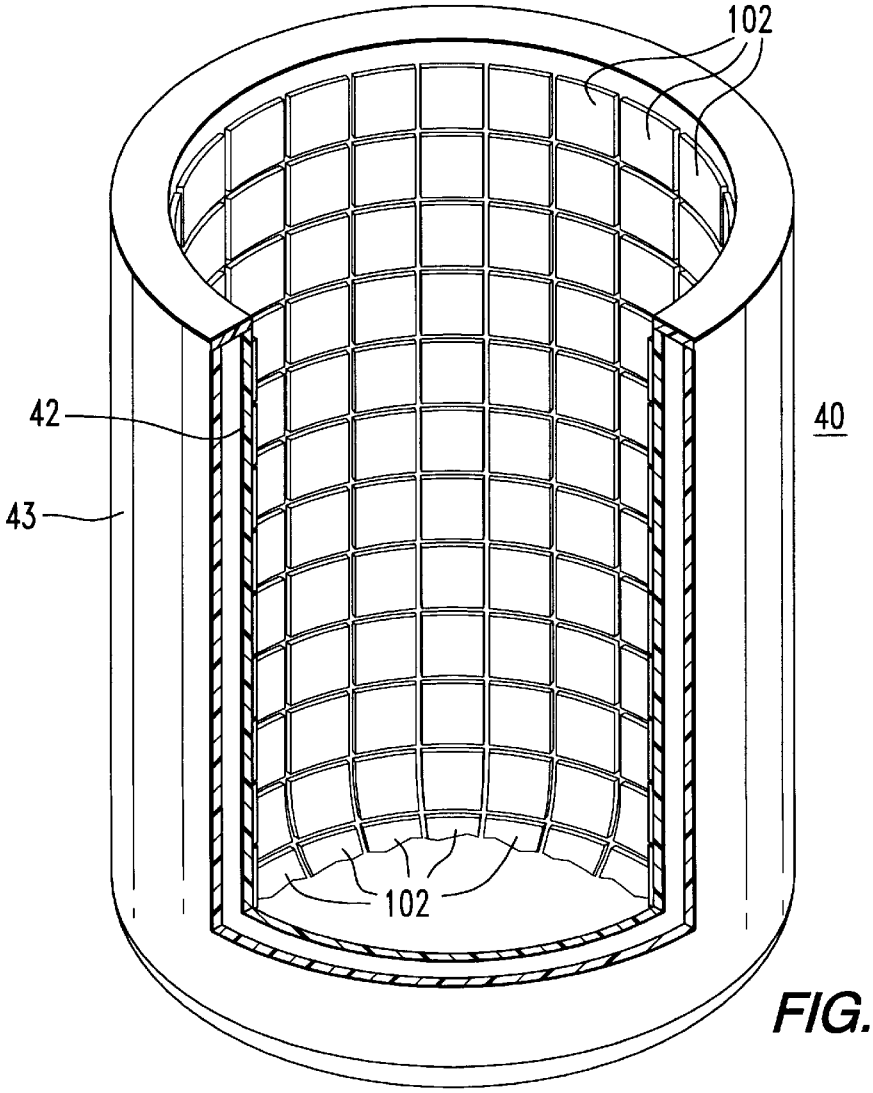

Another protective liner is illustrated in the cut-away view of the cryostat 40 (shown without the cover or interior elements), in FIG. 4. The liner 106 is comprised of a thin metal, segmented into a plurality of non-contacting sheets 108. This segmentation significantly reduces any eddy current heating because large, continuous, circumferential, low resistance current circulation paths, as with an all metal vessel, are replaced with small, localized, high resistance paths. Although there are small gaps between sheets 108, allowing some gas diffusion, the liner 106 could cover approximately 96% of the wall area, and thus the overall wall permeability would be greatly reduced.

With the cryostat of the present invention, for cooling an AC SMES solenoid, AC losses in the vessel walls and cover are essentially zero during charge and discharge operation. Further, there is no liquid helium in contact with the vessel wall so that overall heat transfer from the outside ambient to the liquid helium in the containment vessel 54 is minimized. This significant reduction in overall heat transfer means that less helium liquefication capacity is required for the composite cryostat, compared to a metallic cryostat sized to contain the same size coil.

In addition, the amount of liquid helium required to cool the solenoid 60 is minimized in view of the fact that the liquid helium is contained in a flat bottomed cylindrical vessel 54, slightly larger than the solenoid itself. The composite cryostat 40 will weigh significantly less that a stainless steel cryostat of the same dimensions thus facilitating handling and installation.

Although the present invention has been described with a certain degree of particularity, it is to be understood that various substitutions and modifications may be made without departing from the spirit and scope of the invention as defined in the appended claims.

What is claimed is:

1. Cryostat apparatus for maintaining a superconducting coil in a superconducting state, comprising:

(A) inner and outer vessels having a near vacuum condition therebetween;

(B) a cover member for enclosing the interior of said cryostat;

(C) a containment vessel positioned within said inner vessel and spaced therefrom;

(D) said containment vessel containing said superconducting coil immersed in a cryogenic fluid and (E) means directing gas boiloff of said cryogenic fluid from said containment vessel between said containment vessel and said inner vessel.

2. Apparatus according to claim 1 which includes:

(A) a first thermal shield spaced from, and surrounding said containment vessel.

3. Apparatus according to claim 2 which includes:

(A) a second thermal shield positioned between said inner vessel and said first thermal shield and defining a gas passage between said inner vessel and said second thermal shield, said means directing gas boiloff directing said gas boiloff into said gas passage under said containment vessel.

4. Apparatus according to claim 3 wherein said means directing gas boiloff comprises:

(A) gas conducting tubing positioned over the surface of said first thermal shield and having at least one end in gas communication with the interior of said containment vessel to receive gas boiloff from said cryogenic fluid;

(B) said tubing having another end positioned for discharging said gas boiloff into said gas passage between said inner vessel and said second thermal shield.

5. Apparatus according to claim 1 wherein:

(A) said inner and outer vessels are fabricated of a non-metallic composite material.

6. Apparatus according to claim 1 wherein:

(A) said containment vessel is fabricated of a non-metallic composite material.

7. Apparatus according to claim 3 wherein:

(A) said first and second thermal shields are fabricated of a non-metallic composite material.

8. Apparatus according to claim 5 which includes:

(A) a protective liner covering the inner surface of said inner vessel.

9. Apparatus according to claim 8 wherein:

(A) said protective liner is a relatively gas impervious coating.

10. Apparatus according to claim 9 wherein:

(A) said coating is a resin material devoid of fibers.

11. Apparatus according to claim 8 wherein:

(A) said protective liner is comprised of a plurality of thin non-contacting metallic sheets.

12. Apparatus according to claim 1 which includes;

(A) support means including support columns positioned externally of said cryostat;

(B) means connecting said containment vessel and said coil to said support columns.

13. The apparatus of claim 4 wherein said gas passage discharges said gas boiloff under said cover member adjacent said inner vessel, and including a transfer tube extending through said cover member inward of said inner vessel and through which said gas boiloff passes out of said apparatus.

14. The apparatus according to claim 1 wherein said means directing gas boiloff comprises:

(A) gas conducting tubing having at least one end in communication with the interior of said containment vessel to receive said gas boiloff and having at least one other end positioned for discharging said gas boiloff between said containment vessel and said inner vessel and under said containment vessel.

15. Cryostat apparatus for maintaining a superconducting coil in a superconducting state, comprising:

(A) inner and outer vessels having a near vacuum condition therebetween;

(B) a cover member for enclosing the interior of said cryostat;

(C) a containment vessel positioned within said inner vessel and spaced therefrom;

(D) said containment vessel containing said superconducting coil immersed in a cryogenic fluid;

(E) support means including support columns positioned externally of said inner and outer vessels; and (F) means connecting said containment vessel and said coil to said support columns for supporting said containment vessel and said coil from said support means without the weight of the containment vessel and coil being carried by either said inner vessel or outer vessel.

* * * * *